US010879027B2

(12) United States Patent
Boruta et al.

(10) Patent No.: US 10,879,027 B2
(45) Date of Patent: Dec. 29, 2020

(54) HIGH ENERGY X-RAY GENERATION WITHOUT THE USE OF A HIGH VOLTAGE POWER SUPPLY

(71) Applicant: BECSIS, LLC, South Elgin, IL (US)

(72) Inventors: Nicholas Boruta, South Elgin, IL (US); Michael Boruta, South Elgin, IL (US)

(73) Assignee: BECSIS, LLC, South Elgin, IL (US)

( * ) Notice: Subject to any disclaimer, the term of this patent is extended or adjusted under 35 U.S.C. 154(b) by 0 days.

(21) Appl. No.: 16/491,272

(22) PCT Filed: Mar. 6, 2018

(86) PCT No.: PCT/US2018/021236

§ 371 (c)(1),
(2) Date: Sep. 5, 2019

(87) PCT Pub. No.: WO2018/165222

PCT Pub. Date: Sep. 13, 2018

(65) Prior Publication Data

US 2020/0013576 A1 Jan. 9, 2020

Related U.S. Application Data

(60) Provisional application No. 62/467,565, filed on Mar. 6, 2017.

(51) Int. Cl.
*H01J 35/06* (2006.01)
*H05G 1/24* (2006.01)

(52) U.S. Cl.
CPC ..... *H01J 35/065* (2013.01); *H05G 1/24* (2013.01)

(58) Field of Classification Search
CPC ..... H01J 35/06; H01J 35/064; H01J 35/065; H05G 1/20; H05G 1/22; H05G 1/24
See application file for complete search history.

(56) References Cited

U.S. PATENT DOCUMENTS 6,688,179 B2 2/2004 Potter et al.
8,547,007 B2 * 10/2013 Nagaoka ..... H01J 31/127 313/491

(Continued)

OTHER PUBLICATIONS

Boland, Justin Scott (2005) "Micro electret power generators," Dissertation (Ph.D.), California Institute of Technology. http://resolver.caltech.edu/CaltechETD:etd-06092005-112430. (180 pages).

(Continued)

*Primary Examiner* — Thomas R Artman
(74) *Attorney, Agent, or Firm* — Foley & Lardner LLP

(57) ABSTRACT

A method of generating X-rays includes providing a field-emission diode including two electrodes separated by a gap, a first conductor, a first insulator on a surface of the first conductor, a second insulator on a surface of the first insulator that is not in contact with the first conductor, and a second conductor. The first insulator and the second insulator have trapped electrons at an interface therebetween, and are provided between the first conductor and the second conductor. The method further includes moving the second conductor with respect to the first conductor to induce electrons on the second conductor via electrostatic induction; accelerating the induced electrons across the gap of the field-emission diode; and striking a target with accelerated electrons to produce an X-ray. The first insulator and the second insulator are not the same.

20 Claims, 16 Drawing Sheets

(56) References Cited

U.S. PATENT DOCUMENTS

| | | | | |
|---|---|---|---|---|
| 8,581,308 | B2 | 11/2013 | Potter | |
| 8,616,931 | B2 * | 12/2013 | Nagaoka | G02F 1/133617 445/49 |
| 2004/0007877 | A1 | 1/2004 | Boland et al. | |
| 2007/0237302 | A1 | 10/2007 | Chen et al. | |
| 2010/0215402 | A1 * | 8/2010 | Nagaoka | H01J 31/127 399/168 |
| 2011/0074309 | A1 | 3/2011 | Jeong et al. | |
| 2013/0257263 | A1 * | 10/2013 | Nagaoka | H01J 1/312 313/310 |
| 2014/0161232 | A1 | 6/2014 | Jeong et al. | |
| 2015/0024577 | A1 | 1/2015 | Kato et al. | |
| 2020/0013576 | A1 * | 1/2020 | Boruta | H01J 35/065 |

OTHER PUBLICATIONS

International Search Report and Written Opinion in International Application No. PCT/US2018/021236, dated Jun. 1, 2018 (14 pages).

* cited by examiner

HIGH ENERGY X-RAY GENERATION WITHOUT THE USE OF A HIGH VOLTAGE POWER SUPPLY

CROSS-REFERENCE TO RELATED APPLICATIONS

This application is a U.S. National Phase Application under 35 U.S.C. § 371 of International Application No. PCT/US2018/021236, filed on Mar. 6, 2018, which claims the benefit of U.S. Provisional Application No. 62/467,565, filed on Mar. 6, 2017, the contents of which are hereby incorporated by reference in its entirety their entireties into the present disclosure.

BACKGROUND

The present disclosure relates to an X-ray generator. In particular, the present disclosure relates to systems and methods for generating an X-ray without the use of a high voltage power supply.

The production of high energy X-rays requires high voltage. As used herein, "high voltage" refers to a voltage of 5 KV or higher. For most practical X-ray applications, an additional requirement is that the X-ray tube create a sufficiently large electron beam current in order to generate a large enough X-ray flux to be practical in most applications. Historically these two requirements have forced X-ray tube manufacturers to use expensive high voltage power supplies because there are few other methods that can meet both of these requirements. The source of the electron beam has typically been provided by heating a tungsten filament such that a power supply is required for this process as well.

Alternate methods have been proposed in recent years that generate X-rays at low voltages by using field emission from carbon nanotubes or other nanostructures. These methods generate the high electric fields needed for electron beam field emission because of their very small radius emitting tips which are characteristic of these methods. However, these low voltages limit the energy of the X-rays to relatively low energy applications. So for higher energy X-rays there is still a requirement to apply some type of high voltage power supply. Electrostatic generators such as Van deGraff generators have been used in the past but these are impractical except for such applications as particle accelerators in physics experiments. The magnitude of the currents generated using this method is very limited. So for most practical applications it is still vital to utilize relatively expensive high voltage power supplies.

Referring to FIG. 16, X-ray photons are normally produced by an electron beam that is accelerated to a very high speed and strikes a target. In the typical type of X-ray generator the electrons that make up the beam are emitted from a heated cathode filament. The electrons are then focused and accelerated by an electrical field (generated by a high voltage power supply) towards an angled anode target. The point where the electron beam strikes the target is called the focal spot. Most of the kinetic energy contained in the electron beam is converted to heat, but around 1% of the energy is converted into X-ray photons, the excess heat is dissipated via a heat sink. At the focal spot, X-ray photons are emitted in all directions from the target surface, the highest intensity being around 60° to 90° from the beam due to the angle of the anode target to the approaching electron beam. There is a small round window in the X-ray tube directly above the angled target. This window allows the X-rays to exit the tube with little attenuation while maintaining a vacuum seal required for the X-ray tube operation. Other than the x-ray tube window or port the remaining portion of the x-ray tube housing is lined with lead to absorb all remaining x-rays not usable for image creation.

X-ray generation works by applying a controlled high voltage which accelerates a beam of electrons that ultimately generate the X-rays. The exiting X-ray beam is projected onto an object of interest. Some of the X-ray beam will pass through the object, while some is absorbed. The resulting pattern of the radiation is then ultimately detected by a detection medium such as a rare earth screen (which surrounds photographic film), a semiconductor detector, or X-ray image intensifier.

Almost all current day X-ray tubes require a high voltage power supply that provides the acceleration energy for the electrons. Typical values of the supply voltage range from 5 KVolts to higher than 200 KVolts. This high voltage is necessary in order to generate the high kinetic energy of the electrons required before striking the anode material. This high voltage supply is a substantial part of the cost of generating X-rays in current X-ray tubes. The electrons are usually generated by thermionic emission—by heating a tungsten filament to temperatures of about 1000 K where the a fraction of the electrons will leave the metal and be accelerated by the high voltage towards the anode producing the X-rays.

A need exists for improved technology, including an X-ray generator that may be used to generate X-rays in the field where there is otherwise no available electrical power.

SUMMARY

In one embodiment, a method of generating X-rays comprises providing a field-emission diode comprised of two electrodes separated by a gap, a first conductor, a first insulator on a surface of the first conductor, a second insulator on a surface of the first insulator that is not in contact with the first conductor, and a second conductor, the first insulator and the second insulator having trapped electrons at an interface therebetween and being provided between the first conductor and the second conductor; moving the second conductor with respect to the first conductor to induce electrons on the second conductor via electrostatic induction; accelerating the induced electrons across the gap of the field-emission diode; and striking a target with accelerated electrons to produce an X-ray. The first insulator and the second insulator are not the same.

In one aspect, the first conductor comprises a stator; the second conductor comprises a rotor; and moving the second conductor with respect to the first conductor comprises rotating the rotor with respect to the stator. The rotor may comprise a plurality of sectors including at least one sector comprised of a conductive material and at least one air sector consisting of an opening in the rotor, and a number of sectors comprised of the conductive material equals a number of poles of the rotor. The stator may comprise a plurality of sectors including at least one charge-embedded sector in which the first insulator and the second insulator are provided and at least one empty sector in which the first insulator and the second insulator are not provided. Increasing the number of poles of the rotor increases a generated current without increasing a size of the rotor.

In one aspect, the rotor and the stator comprise a rotor stator assembly. The method further comprises providing a plurality of rotor stator assemblies in a stacked configuration, the rotor stator assemblies being connected in parallel, increasing a number of rotor assemblies increases a generated current.

In one aspect, moving the second conductor with respect to the first conductor comprises moving the second conductor in an up-down direction such that a distance between the first conductor and the second conductor is varied.

In another embodiment, an apparatus for generating X-rays comprises: a first conductor; a first insulator on a surface of the first conductor; a second insulator on a surface of the first insulator that is not in contact with the first conductor, the second insulator being different from the first insulator; a second conductor configured to move with respect to the first conductor to generate electrons; a field-emission diode comprised of two electrodes separated by a gap including an electric field; and a target. The first insulator and the second insulator are provided between the first conductor and the second conductor. Electrons are trapped at an interface between the first insulator and the second insulator. The second conductor is configured to move with respect to the first conductor to induce electrons on the second conductor via electrostatic induction. The induced electrons are configured to be accelerated across the gap of the field-emission diode via field emission. The accelerated electrons are configured to strike the target to produce an X-ray In one aspect of the apparatus, the first conductor comprises a stator; the second conductor comprises a rotor; and the rotor is configured to rotate with respect to the stator. The rotor may comprise a plurality of sectors including at least one sector comprised of a conductive material and at least one air sector consisting of an opening in the rotor. The stator may comprise a plurality of sectors including at least one charge-embedded sector in which the first insulator and the second insulator are provided and at least one empty sector in which the first insulator and the second insulator are not provided. A number of sectors comprised of the conductive material equals a number of poles of the rotor.

In one aspect of the apparatus, the rotor and the stator comprise a rotor stator assembly, and the apparatus further comprises a plurality of rotor stator assemblies in a stacked configuration, the rotor stator assemblies being connected in parallel.

In one aspect of the apparatus, the second conductor is configured to move in an up-down direction such that a distance between the first conductor and the second conductor is varied.

In any of the embodiments of aspects of the method and apparatus described above, the first conductor may comprise silicon; and the second conductor may comprise graphene or molybdenum disulfide.

In any of the embodiments of aspects of the method and apparatus described above, the first insulator may comprise a metal oxide such as silicon dioxide, aluminum oxide, or a combination thereof, or the first insulator may comprise silicon dioxide, calcium fluoride, magnesium fluoride, lithium fluoride, aluminum oxide, or any combination of two or more thereof.

In any of the embodiments of aspects of the method and apparatus described above, the second insulator may comprise silicon nitride, titanium dioxide, strontium titanium oxide, zirconium oxide, barium titanium oxide, or any combination of two or more thereof.

In any of the embodiments of aspects of the apparatus described above, the apparatus does not include an electrical power source.

In any of the embodiments of aspects of the apparatus described above, the apparatus does not include Teflon.

BRIEF DESCRIPTION OF THE DRAWINGS

The disclosure will become more fully understood from the following detailed description, taken in conjunction with the accompanying figures in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring to FIGS. 1-15, an X-ray generator 100 and methods for generating voltage using the X-ray generator 100 rely on a high static electric field generated by localized embedded charge at the interface of two dielectrics (a first insulator and a second insulator). The high voltage generator does not include Teflon. The X-ray generator 100 described in the examples below can hold up to $3\times10^{13}$ electrons/cm$^2$, while Teflon holds about $10^7$ electrons/cm$^2$ (1 million less electrons per square centimeter). Taking advantage of the localized embedded charge at the interface of the two dielectrics instead of using Teflon allows the power output to be greatly enhanced.

Figure 1:
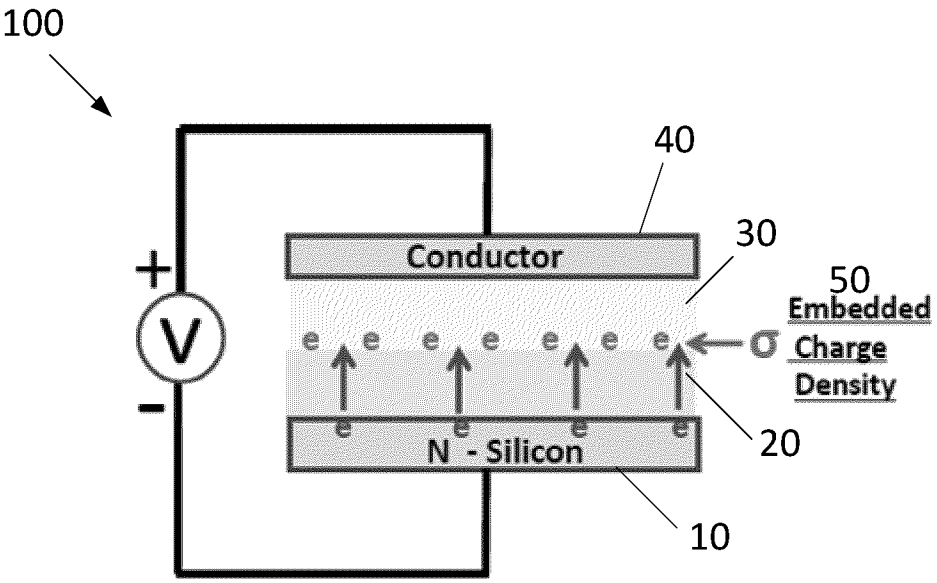
FIG. 1 illustrates an embedded charge structure provided in an X-ray generator.

Referring to FIG. 1, the X-ray generator 100 includes a first conductor 10, a first insulator 20 (e.g., an insulating layer) provided on the first conductor 10, a second insulator 30 (e.g., an insulating layer) provided on the first insulator 20, and a second conductor 40. An interface 50 having very strong electron-charge trapping properties is created between the first insulator 20 and the second insulator 30. The first insulator 20 and the second insulator 30 are not made of the same material (i.e., the first insulator 20 and the second insulator 30 are not the same).

In some examples, the second conductor 40 is configured to move with respect to the fixed first conductor 10. For example, the second conductor 40 may be a rotor configured to rotate, and the first conductor 10 may be a fixed stator. In another example, the second conductor 40 may be moved in an up-down direction such that a distance between the second conductor 40 and the first conductor 10 is increased/decreased. These examples will be discussed in further detail below.

In the X-ray generator 100, electrons are generated by field emission. Field emission occurs when the electric field between two conducting electrodes reaches a critical field (Eo) typically which can range from $10^2$ Volts/cm to $>10^6$ Volts/cm depending on the detailed shape of the emitting electrode. Field emission can be described by Fowler Nordheim tunneling where the high field causes the potential barrier to electron emission to narrow so that electrons can tunnel from the emitter electrode into vacuum and onto the anode. The interface 50 has very strong electron-charge trapping properties between the first insulator 20 and the second insulator 30. For example, the embedded-charge density at the interface 50 has been experimentally measured as high as $3\times10^{13}$ e/cm$^2$. The electric field may be as high as 30 megavolts/cm or about 0.3 V/Å.

The first conductor 10 may be an electron source including elemental silicon such as an N-type silicon substrate or wafer. The second conductor 40 may include monoatomic graphene or molybdenum disulfide. The first insulator 20 may include silicon dioxide, calcium fluoride, magnesium fluoride, lithium fluoride, aluminum oxide, or any combination of two or more thereof, or the first insulator 20 may include a metal oxide. Illustrative metal oxides include, but are not limited to, silicon dioxide, aluminum oxide, or a combination thereof. The second insulating layer 30 may include silicon nitride, titanium dioxide, strontium titanium oxide, zirconium oxide, barium titanium oxide, or any combination of two or more thereof. In some examples, a distance between the first conductor 10 and the second conductor 40 is equivalent to the combined thickness of the first insulator 20 and the second insulator 30. For example, each of the first insulator 20 and the second insulator 30 may have a thickness of 100 nm, such that the distance between the first conductor 10 and the second conductor 40 is 200 nm. In some examples, a distance between the first conductor 10 and the second conductor 40 is greater than the combined thickness of the first insulator 20 and the second insulator 30 due to provision of a gap between the second insulator 30 and the second conductor 40. The first insulator 20 and the second insulator 30 may have the same thickness or different thicknesses.

In some examples, the first insulator 20 and the second insulator 30 may be selected from insulators having a wide band gap or insulators having a low to medium band gap (i.e., a narrow to medium band gap). As used herein, an insulating layer of "wide band gap" refers to an insulating layer having a band gap of over about 6.0 eV. As used herein, an insulating layer of "low to medium band gap" or "narrow to medium band gap" refers to an insulating layer having a band gap of about 5.5 eV or less. For example, the first insulator 20 may be have a wide band gap, while the second insulator 30 has a low to medium band gap. In other example, the first insulator 20 may have a low to medium band gap, while the second insulator 30 has a wide band gap. In yet another example, both the first insulator 20 and the second insulator 30 have a wide band gap. In yet another example, both the first insulator 20 and the second insulator 30 have a low to medium band gap. Insulating layers of wide band gap include, but are not limited to, silicon dioxide, calcium fluoride, magnesium fluoride, lithium fluoride, aluminum oxide, or any combination of two or more thereof. For example, silicon dioxide has band gap of approximately 9 eV and calcium fluoride has a band gap of approximately 12.1 eV. Insulating layers of low to medium band gap include, but are not limited to, silicon nitride, titanium dioxide, strontium titanium oxide, zirconium oxide, barium titanium oxide, or any combination of two or more thereof. For example, silicon nitride has a band gap of approximately 5 eV.

In some examples, an optional mono-graphene layer may be provided on a surface of the second insulator 230 that is not in contact with the first insulator 220. When the graphene layer is included, the graphene layer will 1) act as a conducting electrode to create the high electric field needed in order to tunnel the electrons from the first and second insulators 220, 230 onto the trapping interface 250, and 2) function as a conducting electrode for use in creating a bias field between the graphene and the rotor 240 for neutralizing any ions that may attach to either the stator 210 or the rotor 240. The graphene layer is optional, and thus, may be included or omitted. The graphene layer allows a significant portion of the electric field to pass through since its atomic thickness is significantly less than that of the first and second insulators 220, 230. For example, the first and second insulators 220, 230 may have a thickness of 100 nm, while the graphene layer has a thickness less than its Debye length. The monoatomic graphene layer exhibits good electrical conductivity, while permitting the penetration of the electric field generated by the embedded charge to reach beyond the electrode surface and into the electrolytic medium.

The first insulator 220, the second insulator 230, and/or the graphene layer may be deposited on a surface below. Deposition can be conducted by chemical vapor deposition (CVD) or by other techniques such as sputtering, evaporation, atomic layer epitaxy, molecular beam epitaxy, or a combination thereof.

Figure 2:
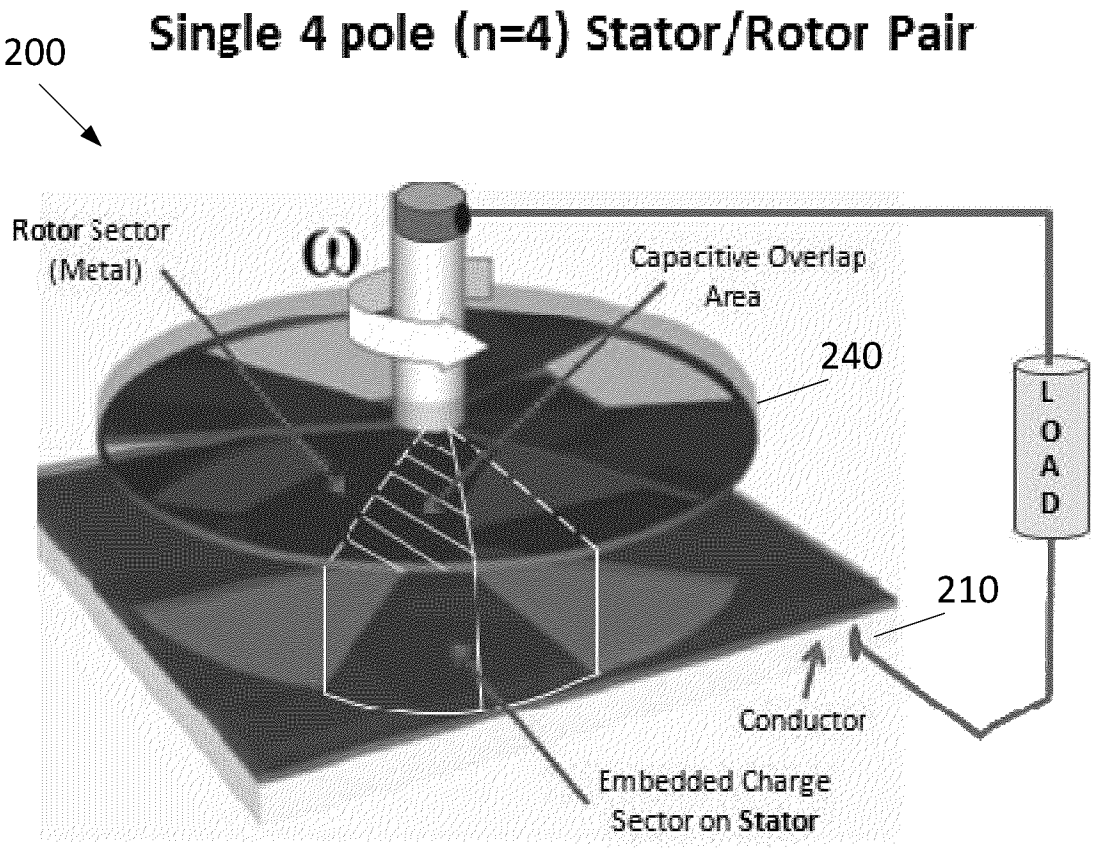
FIG. 2 illustrates an embodiment of a high voltage generator included a rotor stator assembly.

In one example, the X-ray generator 100 is provided in the form of a rotor stator assembly 200. As seen in FIG. 2, the rotor stator assembly 200 includes a fixed stator 210 (e.g., the first conductor 10), a first insulator 220 (e.g., the first insulator 20) provided on the fixed stator 210, a second insulator 230 (e.g., the second insulator 30), and a rotor 240 (e.g., the second conductor 40) configured to rotate with respect to the fixed stator 210. The rotor 240 is comprised of an electrically conductive disk in which a predetermined amount of material has been removed in order to create a desired number of poles. The example of FIG. 2 is a 4-Pole high voltage generator in which the rotor 240 is divided into eight equal sectors of which four sectors are electrical conductors (i.e., conductive sectors) and four sectors are empty air sectors in which the material that forms the rotor 240 has been removed (i.e., empty sectors). Like the rotor 240, the fixed stator 210 has been divided into eight equal sectors in a region corresponding to the projected area of the rotor 240 on the fixed stator 210. Four of the sectors on the fixed stator 210 (i.e., charge-embedded sectors) include the first insulator 220 and the second insulator 230 and thus an interface 250 between the first insulator 220 and the second insulator 230), while the remaining four sectors (i.e., empty sectors) are blank and do not include the first insulator 220 and the second insulator 230.

Figure 3:
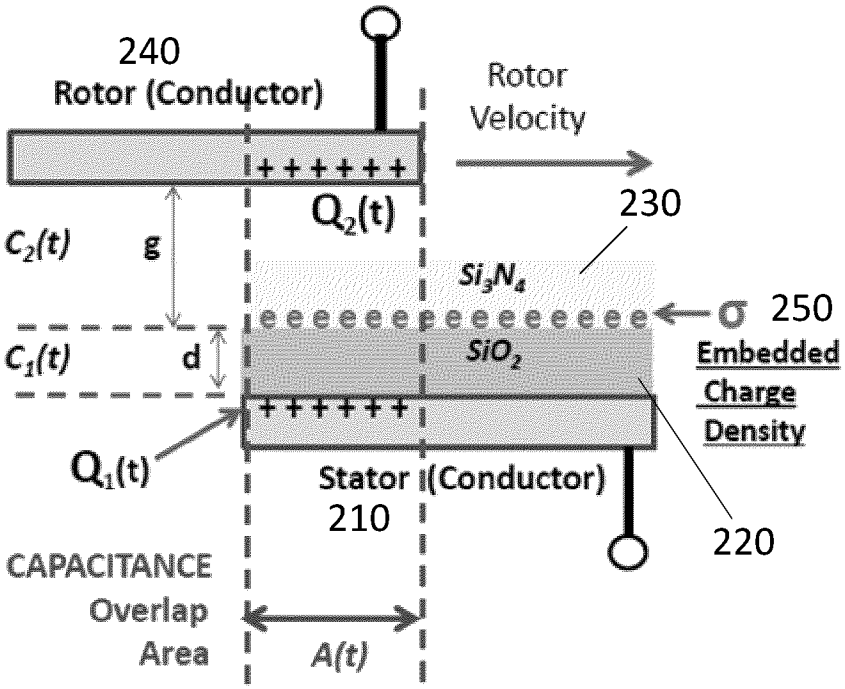
FIG. 3 illustrates a cross-section of a capacitance overlapping section between a conductive sector of a rotor and a charge-embedded sector of a fixed stator of the rotor stator assembly of FIG. 2.

The rotor stator assembly 200 performs two primary functions: 1) generating the high voltage across the load and 2) driving a current through the load. FIG. 3 illustrates a cross-section of a capacitance overlapping section between a conductive sector of the rotor 240 and a charge-embedded sector of the fixed stator 210. In the examples of FIG. 3, the first insulator 220 comprises $SiO_2$, and the second insulator 230 comprises $Si_3N_4$. The interface between the first insulator 220 and the second insulator 230 traps electron charge extremely efficiently providing a local source of high electric field that can induce positive charge on both the upper rotor 240 and the lower stator 210. As the rotor/stator overlap gets greater the induced positive charge in the rotor increases until it reaches maximum charge when the rotor/stator overlap is 100%.

Figure 4:
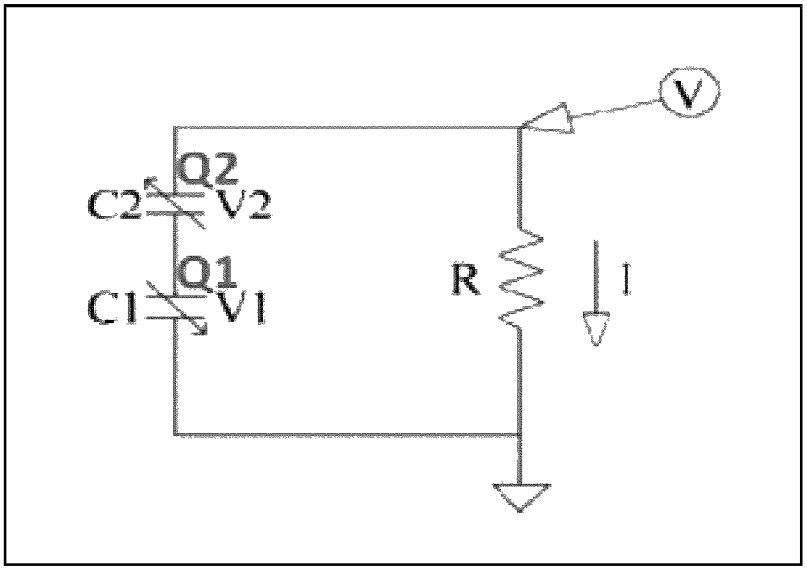
FIG. 4 illustrates a circuit used to model the behavior a of 1-Pole rotor stator assembly.

During this process the positive-charge 'increase' in the rotor is sourced by the flow of negative charges from the rotor to the external circuit (or equivalently, positive-charges from the external circuit). The "external circuit" refers to everything external to the rotor stator assembly 200, such as a simple load, complicated circuitry, etc. In FIG. 4, the external circuit is illustrated as a resistor. For the 1-Pole case, this behavior can be modeled as a circuit with two capacitors in series—with time varying rotor-charge Q2(*t*) and time varying stator-charge Q1(*t*) as shown in FIG. 4. Note that the upper plate of C2 corresponds to the rotor 240, while the lower plate of C1 corresponds to the stator 210. The total voltage across the load is determined by the sum of the voltages V1 across the stator 210 and V2 across the rotor 240.

The basic principle for transforming mechanical energy into electrical energy using electrostatics is based on the idea that coupled capacitors that have at least a one time-varying capacitance will induce currents to flow in an external circuit. Referring to FIG. 3, the top metal conductor (i.e., rotor 240) is capable of horizontal motion relative to the bottom structure, which is a stationary metal conductor (i.e., stator 210) with an overlying $SiO_2/Si_3N_4$ dielectric sandwich layer (i.e., the first insulator 220 and the second insulator 230). Electrons (negative charge) are intentionally introduced and are trapped at the $SiO_2/Si_3N_4$ interface 250. At any time during the movement of the rotor 240, there is an overlap-region between the stator 210 and the rotor 240 that determines the capacitance for this system. The important element is the embedded charge that resides at the interface 250 between the silicon dioxide (i.e., first insulator 220) and the silicon nitride (i.e., second insulator 230). This interface charge density (embedded charge) is trapped at the interface 250 between the two dielectric material insulators and acts as a common plate for the two capacitors in series. The rotor 240 and the embedded charge with distance "g" comprises one capacitor, while the stator 210 with the embedded charge with distance "d" comprises the other capacitor. The common (overlapped) metal surface area between the rotor and the stator capacitors will change in time, thus changing the capacitance according to the usual parallel plate capacitance (C) formula (where A(t) is the overlapped area and d is the plate separation distance).

$$C(t) = \frac{\varepsilon A(t)}{d} \tag{1}$$

The charge stored on the plate of any capacitor is proportional to the capacitance Q(t)=C(t)V where V is the voltage across the capacitor Q(t) is the charge on the plate and C(t) is the capacitance. When C(t) changes, the charge on the plate will also change such that if a path (i.e. an external circuit) is provided for the charge to go to, then an electric current in the external circuit is created. An external voltage across the capacitors is not provided in order to store this charge. The embedded (−) charge induces positive (+) charges on both the rotor 240 and the stator 210, as shown in FIG. 3, so that a voltage across the plates is developed due to these charges. If there is a voltage difference between the rotor 240 and the stator 210, then any externally connected circuit between these plates will see this voltage difference and charges will respond by moving (i.e., current will flow) to 'short out' this voltage difference. Thus, an electric current source is created.

By conservation of charge in the capacitance overlap section:

$$Q_{embed}(t)=Q_1(t)+Q_2(t) \tag{2}$$

where $$Q_{embed}(t)=\sigma A(t) \tag{3}$$

Here σ is the embedded charge density and A(t) is the overlap area.

FIG. 4 shows a schematic of the top rotor capacitor C2 with voltage V2 across its plates connected in series with the bottom stator capacitor C1 with voltage V1 across its plates. An external circuit with a load, namely a resistor, is also shown. Any external circuit with a load may be used (for example, the field emission diode 300 that will be described further below). The total voltage across the series capacitor connection as well as across the load resistor is labeled V.

The two capacitances are determined by the common overlap-area and are given by $$C_1(t) = \frac{\kappa_{OX}\varepsilon_0}{d}A(t) \tag{4}$$

where $\kappa_{OX}$ is the relative permittivity of the oxide dielectric, and $$C_2(t) = \frac{\varepsilon_0}{g}A(t). \tag{5}$$

The voltage (V) across the series-capacitors (as well as the resistor load) is the sum of the voltages across each capacitor $$V(t) = \frac{-Q_1(t)}{C_1(t)} + \frac{Q_2(t)}{C_2(t)} \tag{6}$$

The voltage is defined as zero (i.e. ground) at the positively charged stator electrode. This means that a positive test-charge starting at the stator electrode (at ground) will first see a reduction (− sign) in its potential as it goes across the oxide and reaches the embedded negative charge electrode, hence the negative first term in Eqn. (6). Next the positive test charge will see a positive (+) change in its potential as it goes across the silicon nitride to reach the upper rotor electrode. So the total magnitude of the voltage (potential) generated across the resistor load depends on the capacitance differences between the rotor and the stator capacitors. If the capacitances were the same, Eqn. (6) states that there would be ZERO net voltage difference across the resistor and no current would flow.

Using Eqn. (3) to eliminate $Q_{embed}$ in Eqn. (2) and then plugging Eqn. (4) and (5) into Eqn. (6) provides two equations for unknown charges $Q_1$ (t) and $Q_2$ (t). By eliminating $Q_1$ (t) Eqn. (7) is derived, which describes the voltage in terms of the rotor charge $Q_2$ (t), the embedded charge density σ, the separation distances g and d and the instantaneous overlap area A(t)

$$V(t) = \left(\frac{d}{\kappa\varepsilon_0} + \frac{g}{\varepsilon_0}\right)\frac{Q_2(t)}{A(t)} - \frac{d}{\kappa\varepsilon_0}\sigma \tag{7}$$

The voltage V(t) in Eqn. (7) is also the voltage across the resistive load R as well and will cause current to flow through the load resistor. The voltage across the load resistor can be rewritten as V(t)=I(t)R. But I(t) is just the time-change of the charge (or $$\left(\text{or } -\frac{dQ_2(t)}{dt}\right)$$

where the negative (−) sign has been used for the following reason. Referring to FIGS. 3 and 4, if the positive charge $Q_2$ (t) were to increase, some positive charge must have travelled from the stator electrode (at ground) across the resistor to the rotor electrode (top), which is the opposite (negative) direction of the current, labeled in FIG. 4. Thus, a negative sign is used to fix this. With this replacement for V(t), Eqn. 7 becomes $$-\frac{dQ_2(t)}{dt}R = \left(\frac{d}{\kappa\varepsilon_0} + \frac{g}{\varepsilon_0}\right)\frac{Q_2(t)}{A(t)} - \frac{d}{\kappa\varepsilon_0}\sigma \tag{8}$$

Dividing by R and rearranging the terms a bit, Eqn. (9) is obtained $$\frac{dQ_2(t)}{dt} + \frac{1}{R}\left(\frac{d}{\kappa\varepsilon_0} + \frac{g}{\varepsilon_0}\right)\frac{Q_2(t)}{A(t)} = \frac{1}{R}\left(\frac{d}{\kappa\varepsilon_0}\right)\sigma \tag{9}$$

which is the final differential equation for the rotor charge in terms of all of the other given parameters. The change in the area as a function of time A(t) has been left unspecified in order to accommodate any type of time behavior. Solving this equation for the charge $Q_2$(t), then taking the derivative of this charge with respect to time gives the current induced in the circuit as a function of time.

Referring to FIG. 2, the high voltage generator may be a rotor stator assembly 200 (i.e., a rotary-motion based electrostatic generator). Using the geometry of FIG. 2 and assuming a constant rotation frequency (f-revolutions per sec), then the overlap area A(t) increases linearly in time and is given by the following formulae, where n=the number of poles.

When Area Overlap is increasing:

$$A(t) = f\pi r^2 t \quad \text{for } 0 \le t \le \frac{1}{2nf}$$

When Area Overlap is decreasing:

$$A(t) = \frac{\pi r^2}{n}(1 - nft) \quad \text{for } \frac{1}{2nf} \le t \le \frac{1}{nf}$$

Then the final version of the differential equation for constant rotation frequency f is:

$$\frac{dQ_2(t)}{dt} + \left[\frac{1}{R}\left(\frac{d}{\kappa\varepsilon_0} + \frac{g}{\varepsilon_0}\right)\frac{1}{\pi r^2 f}\right]\frac{Q_2(t)}{t} = \frac{1}{R}\left(\frac{d}{\kappa\varepsilon_0}\right)\sigma \tag{10}$$

where the independent time variable t explicitly appears in the equation. This is a first order differential equation of the general form:

$$\frac{dQ_2(t)}{dt} + \frac{B}{t}Q_2(t) = C \tag{11}$$

Where $$B = \frac{1}{R}\left(\frac{d}{\kappa\varepsilon_0} + \frac{g}{\varepsilon_0}\right)\frac{1}{\pi r^2 f} \text{ and } C = \frac{1}{R}\left(\frac{d}{\kappa\varepsilon_0}\right)\sigma$$

are well-defined constants.

Assuming a solution of the form:

$Q_2$ (t)=αt with α an arbitrary constant, then Eqn. (11) becomes: α+Bα=C or $$\alpha = \frac{C}{B+1}$$

so:

$$Q_2(t) = \frac{C}{B+1}t \tag{12}$$

Putting in the expressions for the constants B and C Eqn. (13) is obtained:

$$Q_2(t) = \left[\frac{\left(\frac{d}{\kappa\varepsilon_0}\right)\sigma}{\left(\frac{d}{\kappa\varepsilon_0} + \frac{g}{\varepsilon_0}\right)\frac{1}{\pi r^2 f} + R}\right]t \tag{13}$$

As mentioned above, the current I(t) can be calculated by taking the negative derivative of Eqn. (13) with respect to time t to get:

$$I = \left[\frac{-\left(\frac{d}{\kappa\varepsilon_0}\right)\sigma}{\left(\frac{d}{\kappa\varepsilon_0} + \frac{g}{\varepsilon_0}\right)\frac{1}{\pi r^2 f} + R}\right] \tag{14}$$

Eqn. (14) shows that the current does not change in time (it is a constant-current source) during the increasing-area overlap period. The same is true during the area-decreasing time.

For the case of a purely resistive load, the generated current I is constant in time during the increasing area overlap time $$0 \le t \le \frac{1}{2nf}.$$

Likewise, the current will have the same magnitude but be opposite in sign during the decreasing area overlap time $$\frac{1}{2nf} \le t \le \frac{1}{nf}.$$

Figure 5:
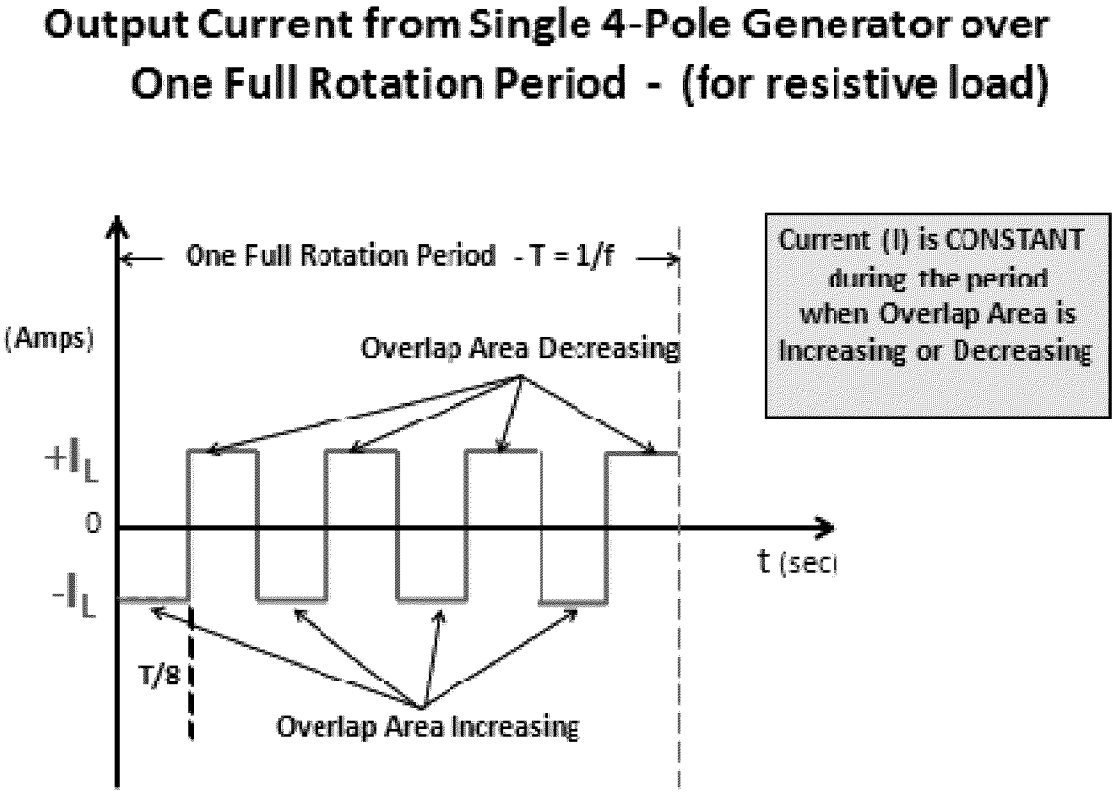
FIG. 5 illustrates the behavior of the current in the model of FIG. 4.

FIG. 5 shows the current for the example of a 4-Pole system over one complete rotational period. The current from Eqn. (14) is the current from a 'single' sector structure shown in FIG. 3; that is, for one capacitive sector (i.e., one pole or n=1). When there are multiple poles (n>1) then the factor n needs to be applied to the results as will be explained.

From FIG. 2, it can be observed that the 4 rotor pole-segments are connected in parallel electrically and the 4 stator pole-segments are connected in parallel. So during the rotary motion, the four currents are in phase and they add directly to give four times the current in Eqn. (14). In general then, for n poles the total current generated is n times Eqn. (14) or $$I_{n_poles} = \left[\frac{-\left(\frac{d}{\kappa\varepsilon_0}\right)\sigma}{\left(\frac{d}{\kappa\varepsilon_0} + \frac{g}{\varepsilon_0}\right)\frac{1}{\pi r^2 f} + R}\right] n \tag{15}$$

Figure 6A:
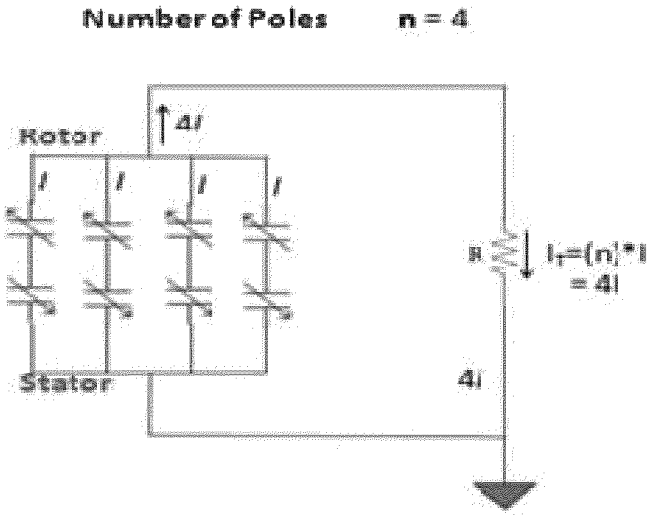
FIGS. 6A and 6B illustrate an increase in the current caused by increasing the number of poles, as compared to the model of FIG. 4.

This is shown schematically for the n=4 case in FIG. 6A.

The output power generated can be determined, since by definition $P=I^2R$, so $$P_{n_poles} = \left[\frac{\left(\frac{d}{\kappa\varepsilon_0}\right)\sigma}{\left(\frac{d}{\kappa\varepsilon_0} + \frac{g}{\varepsilon_0}\right)\frac{1}{\pi r^2 f} + R}\right]^2 n^2 R \tag{16}$$

The output power increases with a quadratic dependence on the number of poles n as well as the charge density σ. The same is true about its dependence on frequency f. However, the dependence on the radius r is approximately proportional to the $4^{th}$ power.

The voltage developed across the resistive load is just given by V=IR. Therefore, the current, voltage and power dissipated in the load can be determined and plotted for various parameter values. In general electrostatic generators typically develop low current and high voltage outputs, whereas, standard 'magnetically' based generators typically create high current, low voltage outputs.

In the case where the load has simple resistive properties, both the total voltage difference (V) as well as the current (I) magnitude stay constant in time during the overlap increasing period as well as during the overlap decreasing period. During the increasing overlap time-period, electrons flow from the rotor through the resistive load to ground so the positive-current pictured in FIG. 5 is negative (−), while during the decreasing overlap time-period electrons flow from ground to the rotor making the direction of the current (I) positive (+). The Voltage (V) stays constant throughout.

Figure 6B:
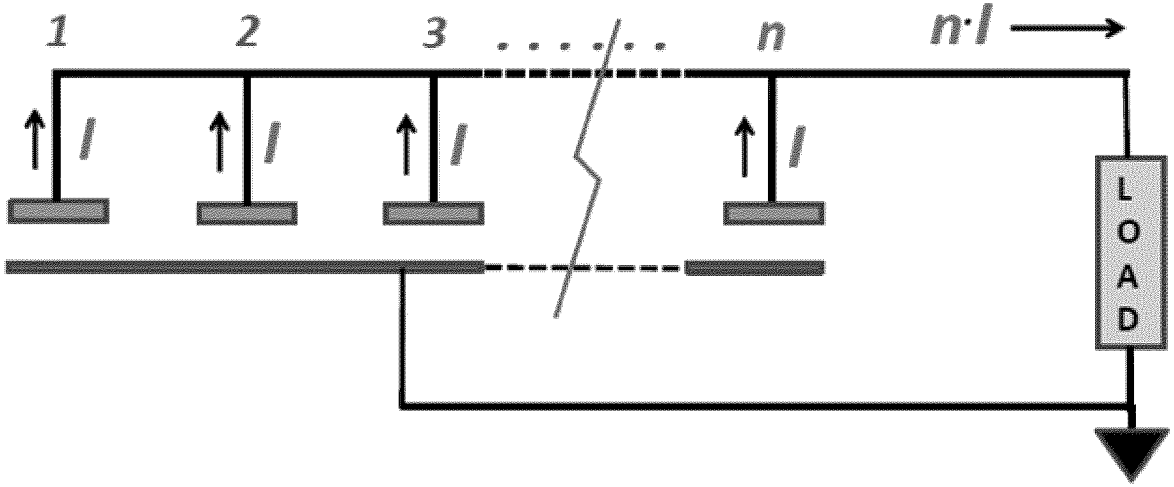
Figure 7:
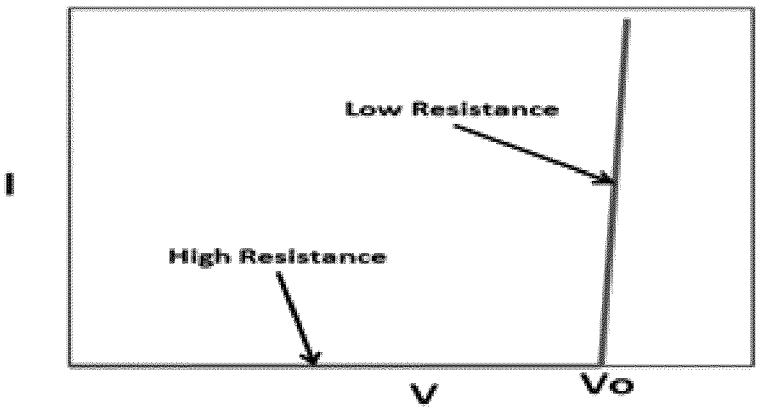
FIG. 7 illustrates a Current-Voltage curve for field emission modeled as a diode.

The behavior of the current (I) is shown in FIG. 5. The number of poles affects the current flowing through the resistor R. Each pole generates the same current regardless of its area. Doubling the number of poles doubles the current. In general if I is the current due to one pole, then n poles will generate a current n*I. For n poles, the number of capacitor pairs is n, and they are physically connected in parallel such that the total current into the load is n times the single pair, as shown in FIGS. 6A and 6B. Thus, the current can be increased by increasing the number of poles, which allows for a simple way to generate a higher current when needed. When the number of poles is increased, the current increases, but the size of the rotor 240 stays the same.

Figure 8:
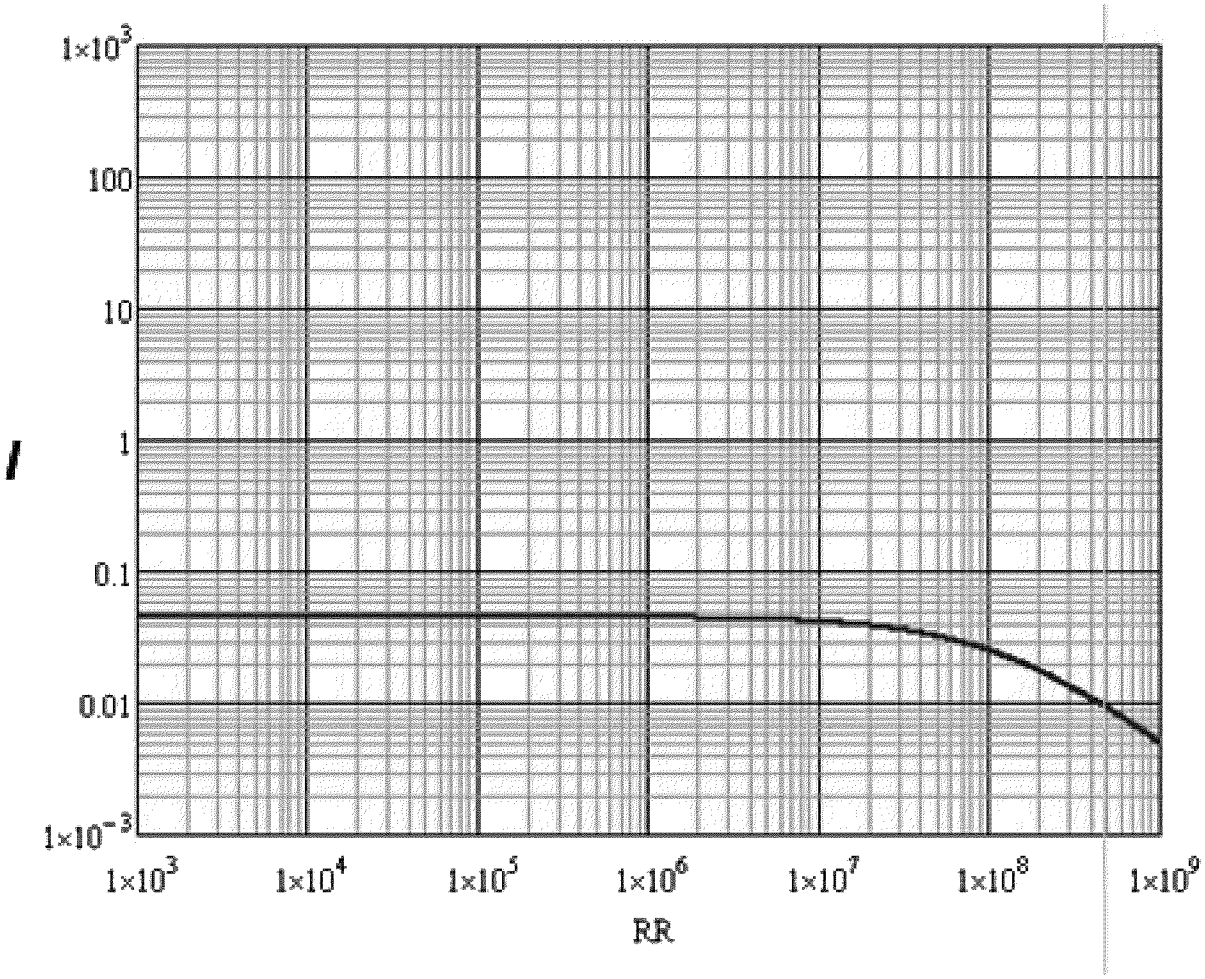
FIG. 8 illustrates the emission beam current (I) as a function of the effective resistance of the emission diode of FIG. 7.

In the rotor stator assembly 200, electrical energy needed to both generate and accelerate electrons is generated directly from mechanical or kinetic motion, namely, the movement of the rotor 240 with respect to the stator 210. A field-emission diode 300 (two electrodes separated by a small gap) is provided, where a high electric field in the gap causes electrons to tunnel from the rotor stator assembly 200 into a vacuum, accelerated across a gap, and strike a target 400 (e.g., an anode) to produce X-rays. The target may be a metal target, for example, a copper target, a molybdenum target, or any other target known to generate X-rays. The Current-Voltage curve for field emission is modeled as a diode in FIG. 7, where the current is essentially zero until the voltage reaches a threshold value (Vo) where the currently rapidly switches to being very high. This behavior can be interpreted in a simple way as a voltage-dependent resistance where it is very large (infinite) below Vo and very small (zero) after reaching Vo. Based on the behavior in terms of the circuit of FIG. 4, calculations may be made using the physics already determined for this case. The results of these calculations are shown in the following curves. FIG. 8 shows the emission beam current (I) as a function of the effective resistance of the emission diode. The emission beam current is constant over a large range of emission diode resistance values and is of the order of 50 mA for a 7 cm radius generator running at 60 Hertz with 20 poles. The gap dimensions d and g (see FIG. 3) in this particular example are d=1 mm and g=0.5 mm. Having a constant emission current allows for the practical control of the X-ray flux. The high voltage generator can generate substantial current, so that the X-ray flux can be substantial as well.

Figure 9:
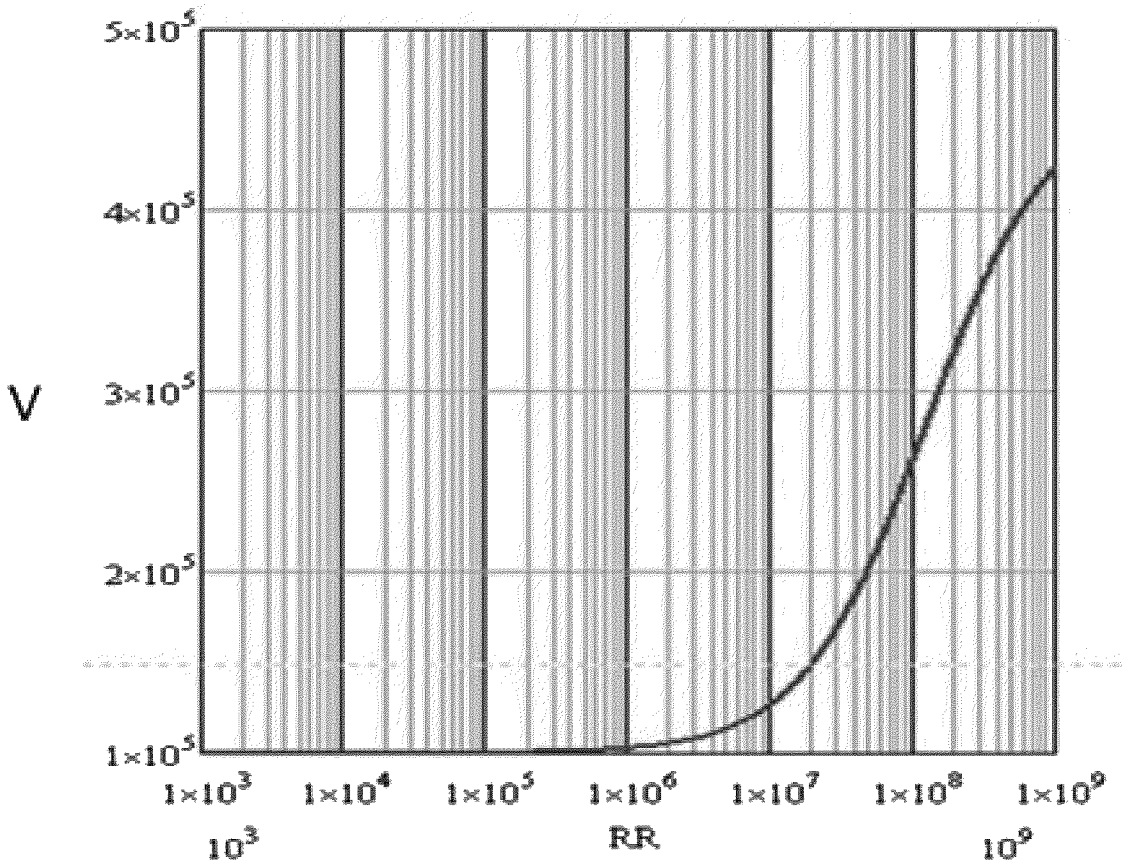
FIG. 9 illustrates an example of the voltage generated across the emission diode of FIG. 7.

FIG. 9 shows an example of the voltage generated across the emission diode. In this example, the critical voltage Vo was chosen to be $10^5$ Volts which translates to a critical field E of either $10^5$ Volts/cm for an electrode gap of 1 cm or $10^6$ Volts/cm for an electrode gap of 1 mm. As mentioned before, the critical voltage can be designed-in and will determine both the energy of the electrons and the energy of the generated X-rays. Because the high voltage generator can generate very high voltage, as well as relatively high electron beam currents, the X-ray exposure times can be reduced substantially in applications requiring high power.

Figure 10:
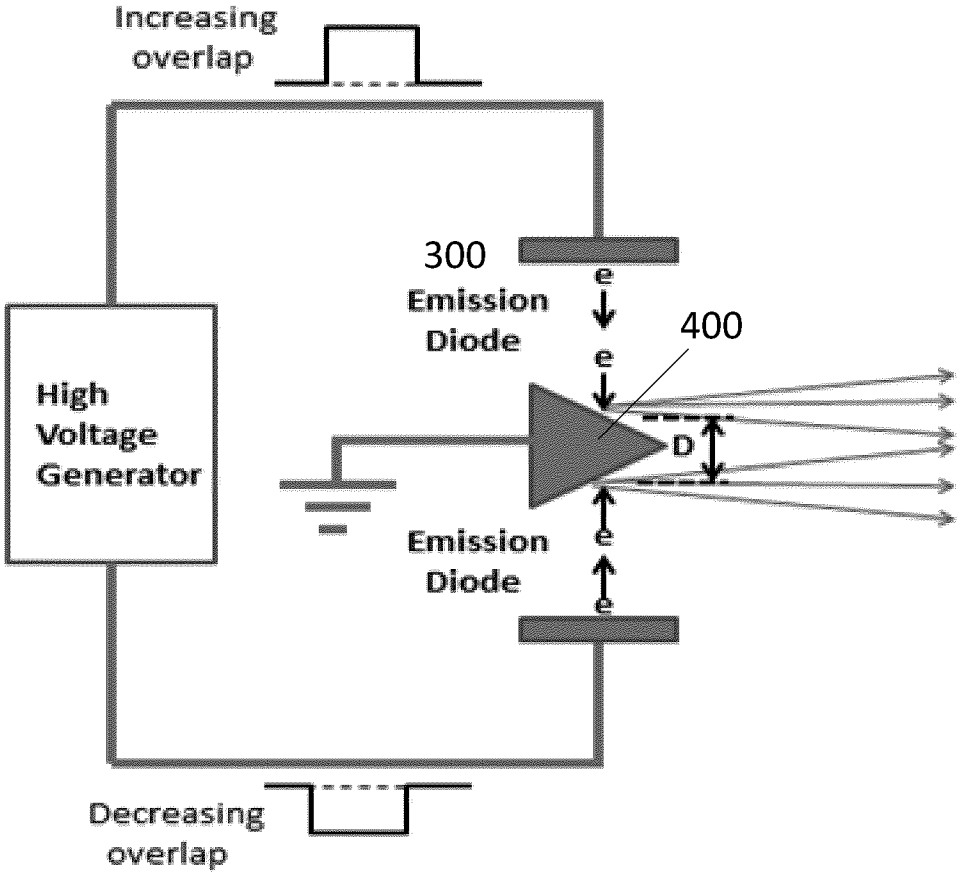
FIG. 10 illustrates a stereoscopic X-ray source created using an anode target.

The behavior shown in FIG. 5 gives this X-ray source a natural stereoscopic capability. The beam current magnitude is constant during both the overlap increasing cycle and decreasing overlap cycle but changes direction during each cycle. If a common (electrically grounded) anode target as shown in FIG. 10 is used, a stereoscopic X-ray source is created, where two X-ray focal spots separated by a distance D result in a stereoscopic X-ray source.

Figure 11:
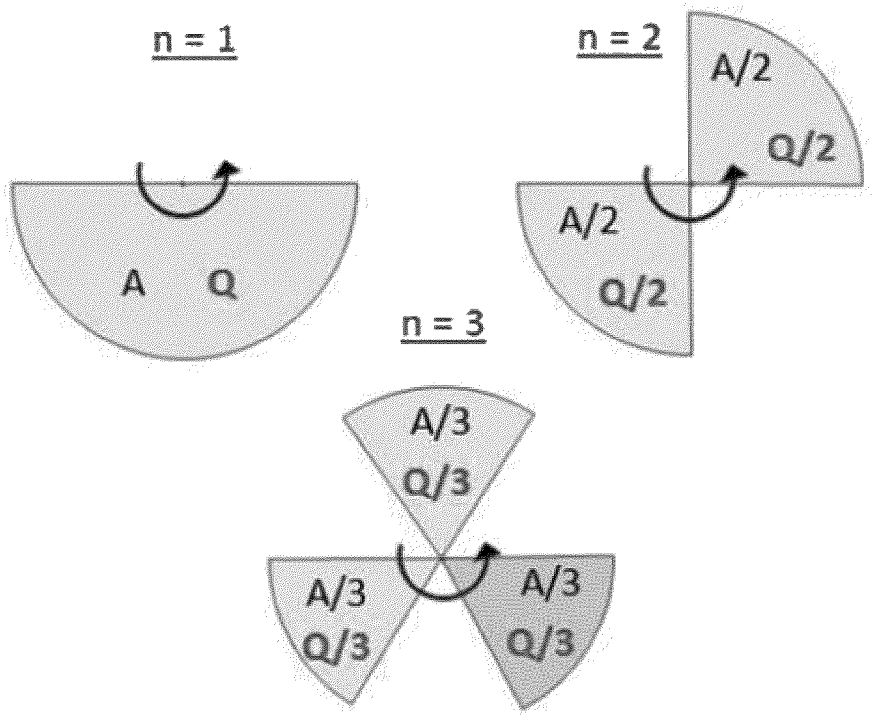
FIG. 11 illustrates examples of a 1-Pole, 2-Pole and 3-Pole generator that can be used in the rotor stator assembly of FIG. 2.
Figure 12:
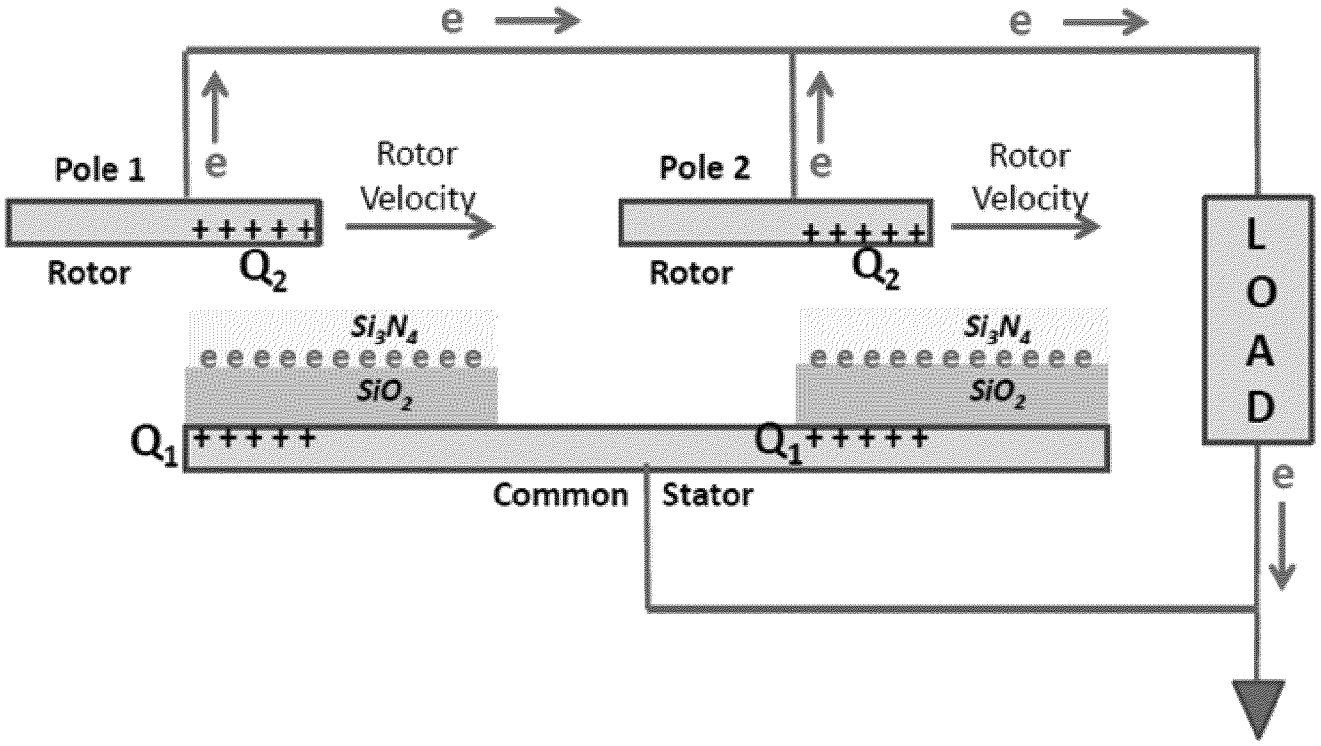
FIG. 12 illustrates electron movement in the 2-Pole generator of FIG. 11.

Although the example of FIG. 2 is a 4-pole high voltage generator, the high voltage generator is not limited in this regard. Referring to FIG. 11, in other examples (described in further detail below), the high voltage generator may include any other number of poles. As seen in FIG. 11, a 1-pole or single pole generator includes a rotor 210 in which half of the area is cut away along the diameter such that half of the rotor disk is an electrical conductor and the other half of the rotor disk (from which the material has been removed) is air. In other words, there are two equal rotor disk sectors, where one is an electrical conductor and the other is air. A 2-Pole generator (see FIG. 12) includes four sectors (cutting the rotor disk along 90 degree lines along the diameter) such that there are two conductive sectors and two empty sectors. A 3-Pole generator includes six sectors such that there are three conductive sectors and three empty sectors. In other words, the number poles is equal to the total number of sectors (i.e., number of conductive sectors and number of empty sectors) divided by two.

Figure 13:
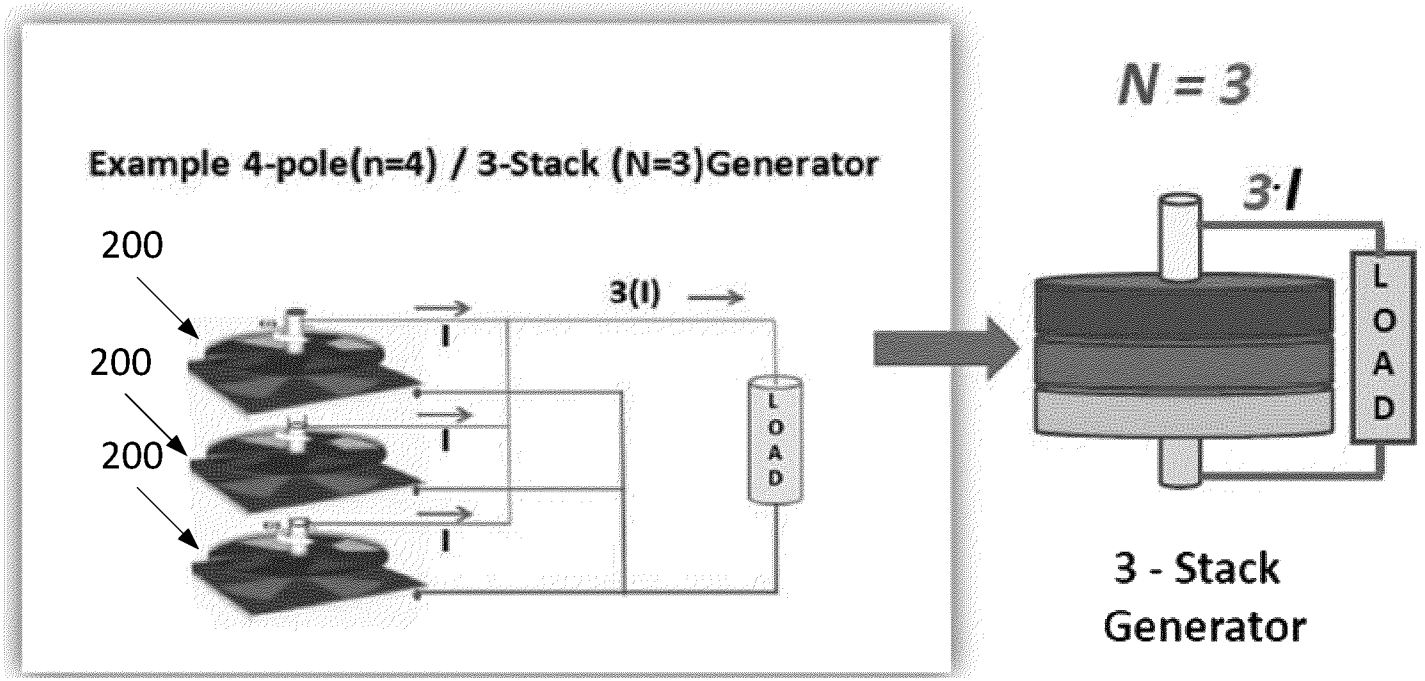
FIG. 13 illustrates an example in which a plurality of the rotor stator assemblies of FIG. 2 are stacked.

In further examples, a plurality of rotor stator assemblies 200 may be stacked. In particular, referring to FIG. 13, N number of rotor stator assemblies may be stacked in a parallel electrical connection in order to increase the electron beam current/by a factor of N. Although a stack including three rotor assemblies 200 is illustrated in FIG. 13, the invention is not limited in this regard. Any number of rotor assemblies 200 may be stacked, for example, 2, 3, 4, 5, 10, 20, 100, etc. It is possible to increase both the number of poles in a single rotor stator assembly and provide a stack including a plurality of rotor stator assemblies to increase the total beam current as follows:

$$\text{Total Beam Current}=(N\times n)I,$$

Where I is the current due to a single pole, n is the number of poles, and N is the number of rotor stator assemblies in the stack.

Figure 14:
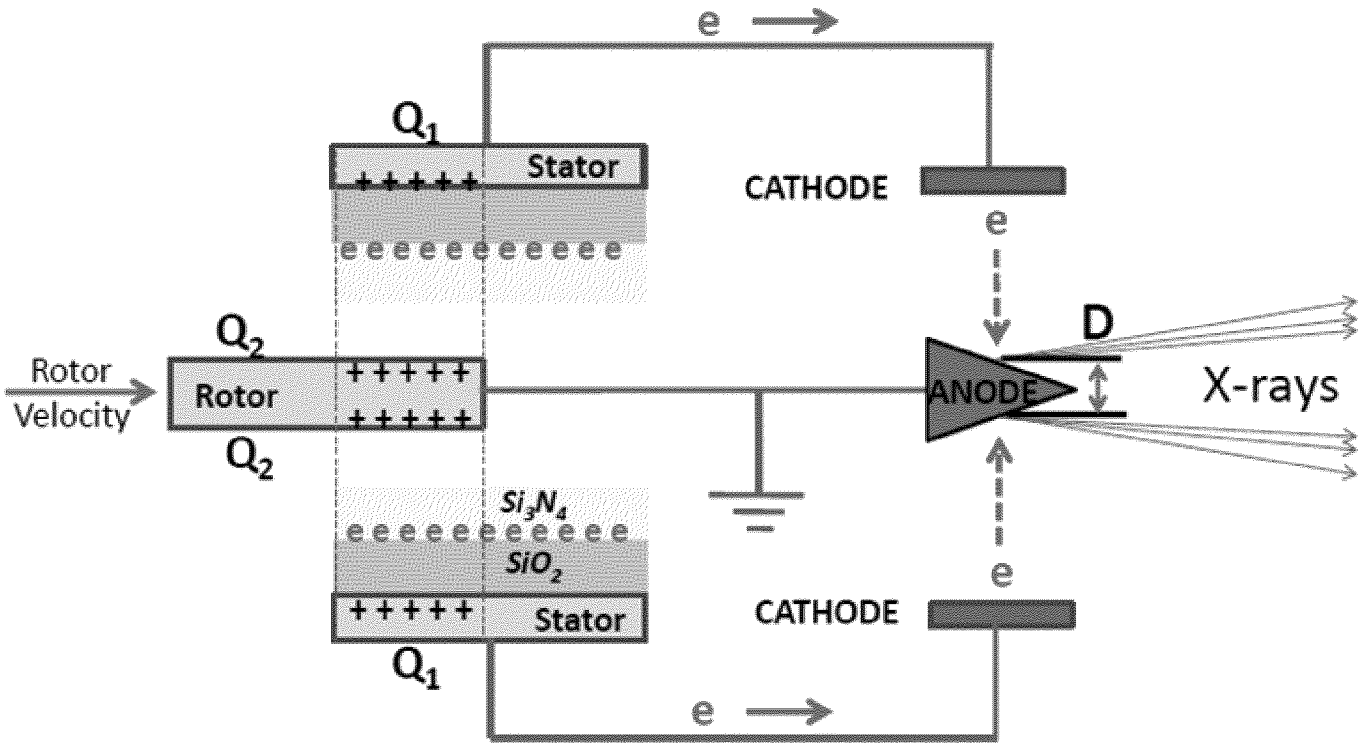
FIG. 14 illustrates an example in which a rotor stator assembly includes a single rotor and a plurality of stators.

In further examples, referring to FIG. 14, it is possible to include a single rotor, and two fixed stators, where the first and second insulators are provided on each of the stators. FIG. 14 illustrates a physical embodiment of the schematic illustrated in FIG. 10. As seen in FIG. 14, the anode is grounded.

As an alternative to the rotor stator assembly 200 described above, in other embodiments, rather than having a rotating rotor along with the stator as shown in FIG. 2, an alternate approach would be to have the upper ("rotor") element (i.e., second conductor 40) exhibit a vertical motion relative to the lower stator element (i.e., first conductor 10). In other words, vertical reciprocal motion would replace the rotary motion described above. This motion would also generate a high voltage and a substantial current—depending on the detailed kinematics (velocity and acceleration of the "rotor" moving up and down. As the separation distance between the upper electrode ("rotor") and the embedded charge layer increases, the capacitance C2 decreases in time thereby reducing the induced positive charge in the rotor which implies positive charge leave the rotor and towards the load-positive current I is generated. During the reverse reciprocal travel where the separation distance decreases the opposite occurs—negative current I is generated. Stereoscopic X-ray generation is again produced by this approach, although the X-rays will have a more pulsed behavior than in the rotary case.

In each example described above, the first insulator and the second insulator are provided on the stator. However, the invention is not limited in this regard. In other examples, the first insulator and the second insulator may be provided on the rotor instead of the stator.

In the examples described above, the embedded charge is produced at the interface between two insulators (dielectrics). The invention is not limited in this regard. In other examples, more than two insulating layers may be provided, for example, 2, 3, 4, 5, 6, 7, 8, 9, or 10, or more layers. In examples in which a third insulator is provided on the second insulator, the third insulator may include silicon dioxide, calcium fluoride, magnesium fluoride, lithium fluoride, aluminum oxide, or any combination of two or more thereof, or the third insulating layer may include a metal oxide including silicon dioxide, aluminum oxide, or a combination thereof. An electronic charge trip is provided at the interface between adjacent insulators.

In some examples, the embedded charge is provided at the interface of each insulating layer of wide band gap and each insulating layer of narrow to medium band gap within a set of alternating adjacent insulating layers of wide band gap or narrow to medium band gap. This includes a set of alternating adjacent insulating layers of wide band gap or narrow to medium band gap containing 2, 3, 4, or 5 layers. In some embodiments, the set of alternating adjacent insulating layers of wide band gap or narrow to medium band gap contains two insulating layers of wide band gap separated by an insulating layer of narrow to medium band gap. In some embodiments, the set of alternating adjacent insulating layers of wide band gap or narrow to medium band gap contains two insulating layers of narrow to medium band gap separated by an insulating layer of wide gap. In some embodiments, the set of alternating adjacent insulating layers of wide band gap or narrow to medium band gap contains two insulating layers of wide band gap and two insulating layers of narrow to medium band gap. In some embodiments, the set of alternating adjacent insulating layers of wide band gap or narrow to medium band gap contains three insulating layers of wide band gap, each separated by an insulating layer of narrow to medium band gap. In some embodiments, the set of alternating adjacent insulating layers of wide band gap or narrow to medium band gap contains three insulating layers of narrow to medium band gap, each separated by an insulating layer of wide band gap. The insulating layers of wide band gap may all be the same or different. One or more of the insulating layers of wide band gap may be the same. One or more of the insulating layers of wide band gap may be different. The insulating layers of low to medium band gap may all be the same or different. One or more of the insulating layers of low to medium band gap may be the same. One or more of the insulating layers of low to medium band gap may be different.

Figure 15:
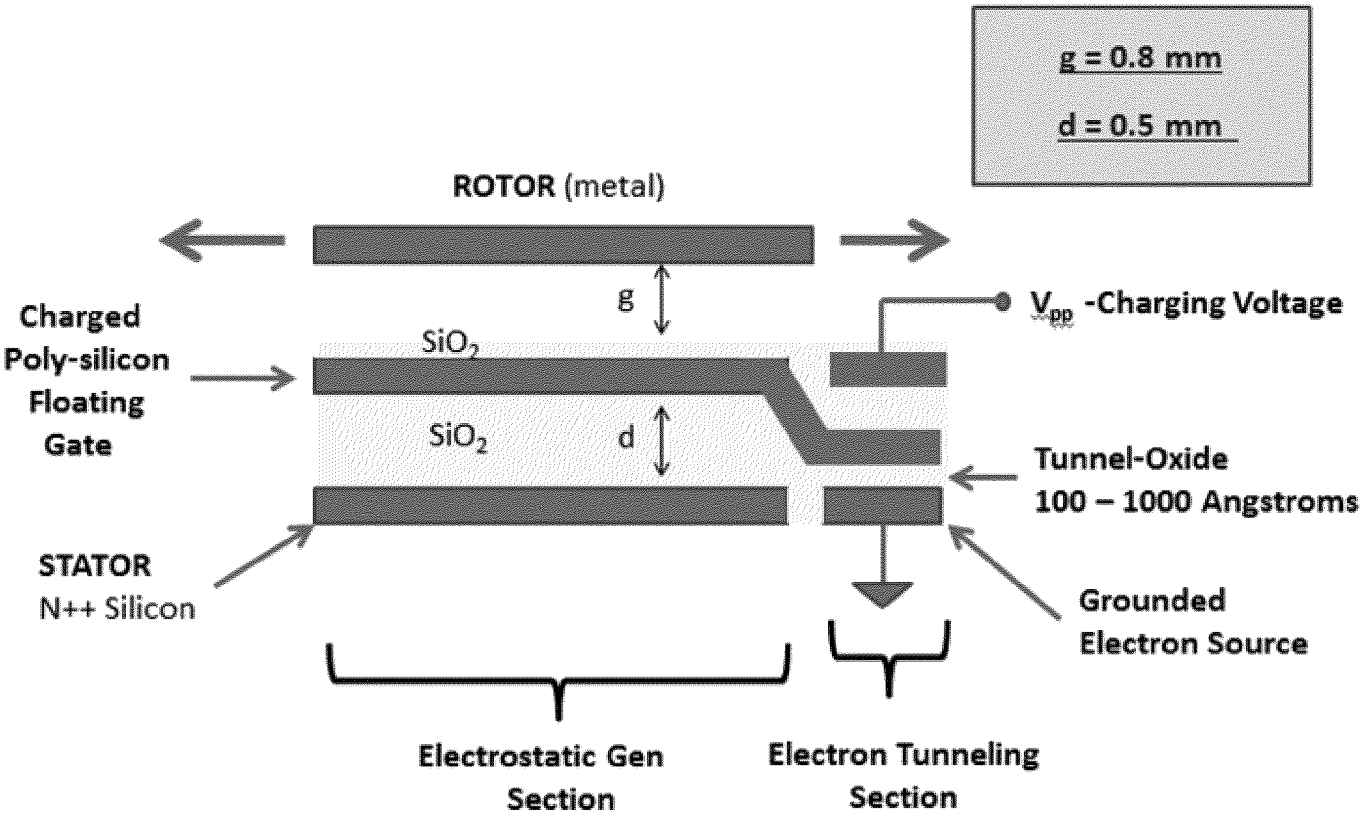
FIG. 15 illustrates an example in which a floating-gate is provided between a first insulator and a second insulator.
Figure 16:
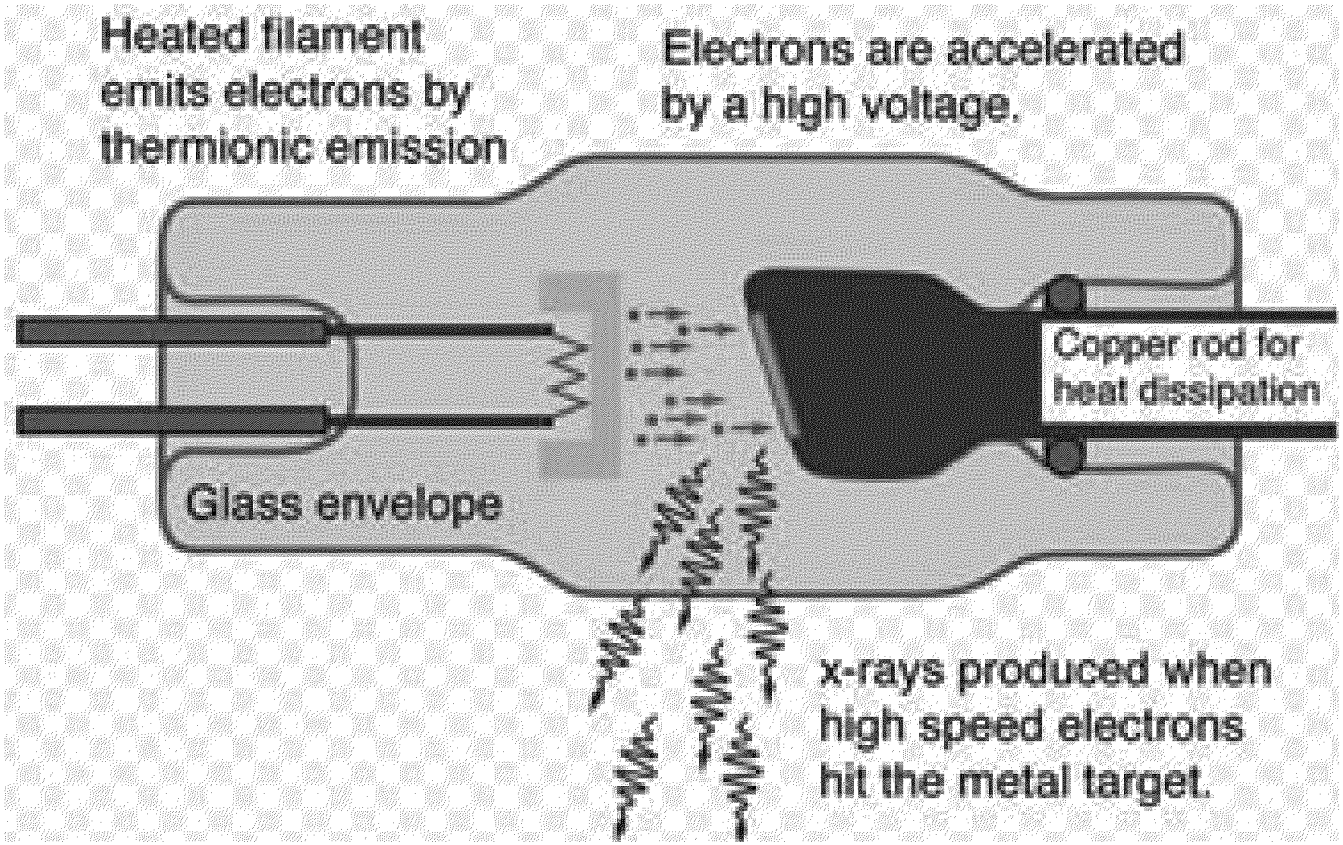
FIG. 16 PRIOR ART
FIG. 16 illustrates a prior art system for generating X-rays.

Referring to FIG. 15, in some examples, a floating gate containing a conductor or semiconductor may be provided at the interface between the first and second insulators. In some embodiments, the floating gate contains a doped polysilicon.

The floating gate may be charged by the use of tunnel oxide with Fowler-Nordheim Tunneling through a thin gate to a charge density, for example, of $10^{13}$ electrons/$cm^2$. A floating gate is capable of holding charges (e.g., electrons) in a similar manner as the interface between insulating layers of wide band gap and narrow to medium band gap in the absence of a floating gate. The difference between former and the latter is that embedded charges at the interface cannot generally be removed using an electric field whereas charges in a floating gate can be removed by applying a larger electric field.

As discussed above, the method for generating X-rays does not require a high voltage power supply (e.g., an electrical power source such as a battery). Because a high voltage power supply is not needed, X-rays may be generated where there is no available electrical power such as in the field.

The construction and arrangements of the high voltage generator and the methods of generating a voltage, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, image processing and segmentation algorithms, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

What is claimed:

1. A method of generating X-rays comprises:

providing a field-emission diode comprised of two electrodes separated by a gap, a first conductor, a first insulator on a surface of the first conductor, a second insulator on a surface of the first insulator that is not in contact with the first conductor, and a second conductor, the first insulator and the second insulator having trapped electrons at an interface there between and being provided between the first conductor and the second conductor;

moving the second conductor with respect to the first conductor to induce electrons on the second conductor via electrostatic induction;

accelerating the induced electrons across the gap of the field-emission diode; and striking a target with accelerated electrons to produce an X-ray, wherein the first insulator and the second insulator are not the same.

2. The method of claim 1, wherein:

the first conductor comprises a stator;

the second conductor comprises a rotor; and moving the second conductor with respect to the first conductor comprises rotating the rotor with respect to the stator.

3. The method of claim 2, wherein:

the rotor comprises a plurality of sectors including at least one sector comprised of a conductive material and at least one air sector consisting of an opening in the rotor; and a number of sectors comprised of the conductive material equals a number of poles of the rotor.

4. The method of claim 3, wherein increasing the number of poles of the rotor increases a generated current without increasing a size of the rotor.

5. The method of claim 3, wherein the stator comprises a plurality of sectors including at least one charge-embedded sector in which the first insulator and the second insulator are provided and at least one empty sector in which the first insulator and the second insulator are not provided.

6. The method any of claim 2, wherein the rotor and the stator comprise a rotor stator assembly, and the method further comprises:

providing a plurality of rotor stator assemblies in a stacked configuration, the rotor stator assemblies being connected in parallel, wherein increasing a number of rotor assemblies increases a generated current.

7. The method of claim 1, wherein moving the second conductor with respect to the first conductor comprises moving the second conductor in an up-down direction such that a distance between the first conductor and the second conductor is varied.

8. An apparatus for generating X-rays comprising:

a first conductor;

a first insulator on a surface of the first conductor;

a second insulator on a surface of the first insulator that is not in contact with the first conductor, the second insulator being different from the first insulator;

a second conductor configured to move with respect to the first conductor to generate electrons;

a field-emission diode comprised of two electrodes separated by a gap including an electric field; and a target, wherein electrons are trapped at an interface between the first insulator and the second insulator, the first insulator and the second insulator are provided between the first conductor and the second conductor, the second conductor is configured to move with respect to the first conductor to induce electrons on the second conductor via electrostatic induction, the induced electrons are configured to be accelerated across the gap of the field-emission diode via field emission, and the accelerated electrons are configured to strike the target to produce an X-ray.

9. The apparatus of claim 8, wherein:

the first conductor comprises a stator;

the second conductor comprises a rotor; and the rotor is configured to rotate with respect to the stator.

10. The apparatus of claim 9, wherein:

the rotor comprises a plurality of sectors including at least one sector comprised of a conductive material and at least one air sector consisting of an opening in the rotor; and a number of sectors comprised of the conductive material equals a number of poles of the rotor.

11. The apparatus of claim 10, wherein:

the stator comprises a plurality of sectors including at least one charge-embedded sector in which the first insulator and the second insulator are provided and at least one empty sector in which the first insulator and the second insulator are not provided.

12. The apparatus of claim 9, wherein the rotor and the stator comprise a rotor stator assembly, and the apparatus further comprises:

a plurality of rotor stator assemblies in a stacked configuration, the rotor stator assemblies being connected in parallel.

13. The apparatus of claim 8, wherein the second conductor is configured to move in an up-down direction such that a distance between the first conductor and the second conductor is varied.

14. The apparatus of claim 8, wherein:

the first conductor comprises silicon; and the second conductor comprises graphene or molybdenum disulfide.

15. The apparatus of claim 14, wherein the first insulator comprises a metal oxide.

16. The apparatus of claim 14, wherein the first insulator comprises silicon dioxide, aluminum oxide, or a combination thereof.

17. The apparatus of claim 14, wherein the first insulator comprises silicon dioxide, calcium fluoride, magnesium fluoride, lithium fluoride, aluminum oxide, or any combination of two or more thereof.

18. The apparatus of claim 8, wherein the second insulator comprises silicon nitride, titanium dioxide, strontium titanium oxide, zirconium oxide, barium titanium oxide, or any combination of two or more thereof.

19. The apparatus of claim 8, wherein:

the first conductor comprises silicon;

the second conductor comprises graphene or molybdenum disulfide;

the first insulator comprises a metal oxide; and the second insulator comprises silicon nitride, titanium dioxide, strontium titanium oxide, zirconium oxide, barium titanium oxide, or any combination of two or more thereof.

20. The apparatus of claim 8, wherein the apparatus does not include an electrical power source.

* * * * *